United States Patent [19]

Stein et al.

[11] Patent Number: 4,554,035

[45] Date of Patent: Nov. 19, 1985

[54] METHOD OF MANUFACTURING A SLIDE GATE

[75] Inventors: Joseph L. Stein, Pittsburgh, Pa.; Thomas J. Maskell, Niles, Ohio

[73] Assignee: General Refractories Company, Bala Cynwyd, Pa.

[21] Appl. No.: 589,052

[22] Filed: Mar. 15, 1984

Related U.S. Application Data

[60] Continuation of Ser. No. 461,104, Jan. 26, 1983, abandoned, which is a division of Ser. No. 339,511, Jan. 15, 1982, Pat. No. 4,383,624, which is a continuation of Ser. No. 843,112, Oct. 17, 1977, abandoned.

[51] Int. Cl.[4] ..... B32B 31/20

[52] U.S. Cl. ..... 156/89; 156/242; 222/559; 222/591; 222/600; 264/30

[58] Field of Search ..... 156/89, 242, 245; 222/591, 594, 600; 264/60, 109, 241; 106/58

[56] References Cited

U.S. PATENT DOCUMENTS

| | | | |
|---|---|---|---|
| 3,044,889 | 7/1962 | Ekedahl et al. | 106/58 |
| 3,196,504 | 7/1965 | Limes | 222/591 |
| 3,197,528 | 7/1965 | Warga et al. | 264/30 |
| 3,409,716 | 11/1968 | Lubey | 264/30 |
| 3,685,707 | 8/1972 | Shepland | 222/600 |
| 3,866,806 | 2/1975 | Shepland | 222/600 |
| 3,970,283 | 7/1976 | Hind | 222/559 X |
| 4,182,466 | 1/1980 | Fehling et al. | 222/600 |

*Primary Examiner*—Caleb Weston

*Attorney, Agent, or Firm*—Finnegan, Henderson, Farabow, Garrett & Dunner

[57] ABSTRACT

A refractory slide gate for a container dispensing molten material is comprised of a metal-supporting can filled with a low-fired coherent bonded refractory. The refractory is formed into a coherent refractory body within the metal supporting can and is directly affixed thereto, without the use of refractory mortar. An orifice through the refractory controls the flow of molten material.

11 Claims, 3 Drawing Figures

METHOD OF MANUFACTURING A SLIDE GATE

CROSS-REFERENCE TO RELATED APPLICATIONS

This is a continuation of Ser. No. 461,104, filed Jan. 26, 1983, now abandoned, which is a divisional of Ser. No. 339,511, filed Jan. 15, 1982, now U.S. Pat. No. 4,383,624, which is a continuation of Ser. No. 843,112, filed Oct. 17, 1977, now abandoned.

BACKGROUND OF THE INVENTION

The present invention relates to a sliding gate mechanism for a bottom pouring vessel used for the storage, transport and dispensing of molten materials such as liquid metals.

In such devices, such as casting ladles or tundish pouring systems, the flow of molten metal from the vessel is controlled by a sliding gate mechanism. Such mechanisms typically consist of a series of shutter plates having orifices or holes therethrough. The plates are attached under the vessel such that the plates may be displaced with respect to each other thereby aligning or misaligning the orifices. This allows the liquid metal to flow from the vessel at a rate dependent upon the degree of coaxial alignment of the orifices.

Sliding gate valve systems have been successfully used to control molten metal flow from containing vessels for several years. Examples of typical sliding gate valve systems can be found in U.S. Pat. Nos. 3,918,613 to Shapland and 3,581,948 to Detalle.

There are numerous advantages associated with using a sliding gate mechanism for pouring molten metals as compared to other flow-controlling mechanisms such as those using a stopper and an associated stopper rod. The absence of the stopper rod mechanism leading out of the container makes the slide gate pouring system particularly useful in vacuum or continuous casting. The sliding gate system, being outside the containing vessel, is less susceptible to the damaging effects of metal temperatures, chemical attack from molten slag and metal erosion. In addition, the sliding gate system more effectively controls molten metal flow by controlling the degree of coaxial alignment of the orifices in the sliding plates.

Conventionally, sliding gate mechanisms include a prefired refractory plate which is assembled into a metal-supporting can after firing. The refractory/metal assembly is securely attached to the bottom of the vessel containing molten metal. Another refractory/metal assembly is matched to the first such that the degree of coaxial alignment of the orificess in the refractory plates will control the rate of molten metal flow from the vessel, through the sliding gate mechanism and into the appropriate mold. In order to insure an effective seal between the refractory plates in the sliding gate mechanism, the mating surfaces of the prefired refractory plates are precision ground before they are attached to the containing vessel. This grinding operation normally occurs after the refractory is assembled into the supporting can, but the grinding operation may also be carried out prior to the assembly of the refractory into the metal can.

The actual manufacture and assembly of the precision ground refractory is critical to the successful operation of the sliding gate system. A key element in this operation is the assembly of the prefired refractory plate and its supporting metal can. The bond between the refractory and the metal can is crucial. Weak bonds between the refractory and the metal can cause the refractory plate to wobble or shift within the metal can. This shifting hampers efforts to obtain a precision ground surface on the matching faces of the refractories necessary to form an effective seal. If an effective seal cannot be formed, the entire assembly must be scrapped. In addition, if weak bonds are not discovered during assembly or during the grinding operation and the assembly is used to control the molten metal flow in a containing vessel, the refractory plate may shift when the sliding gate mechanism is used. The shifting may hamper the closing of the valve, causing leaks and, in general, may create a dangerous situation for operating personnel.

Currently, refractory/metal assemblies of the prior art are produced by pressing a prefired refractory plate into a preformed metal can using a refractory mortar as the bonding medium. In order to accomplish this operation, the refractory mortar must be fluid enough to flow around the refractory plate during pressing such that the space (usually $\frac{1}{8}$–$\frac{1}{4}$ inch) between the plate and the metal can is filled with mortar. A mortar with sufficient fluidity to fill this space undergoes considerable shrinkage upon firing. Assemblies made in this manner exhibit significant amounts of separation between the metal can and the refractory plate where the mortar has shrunk from the metal can. This type of bonding is dependent on the mechanical locking associated with flaws or irregularities in the metal can. This means of locking the refractory plate to the metal can is unsatisfactory and refractory plates have been known to separate totally from the metal can and fall out of the assembly.

Another disadvantage of the prior art method of assembling the refractory in the metal can is the pressing operation. The pressing of prefired refractory plates that are slightly warped, flawed or dimensionally inaccurate can cause damage to the part which, in turn, causes the assembly to be scrapped. Even if the refractory plate is dimensionally correct, if it is pressed in a metal can containing too thick or too stiff a mortar, or if there is an improper distribution of this stiff mortar in the metal can, the refractory plate or the metal can will be damaged by the pressing operation.

Still another disadvantage of this prior art assembly method is that uneven distribution of mortar between refractory plate and metal can can develop uneven stress distributions in the assembly. During the grinding operation, this may cause cracking of the refractory plate.

Yet another disadvantage of this operation is that the layer of mortar between refractory plate and metal can is necessarily thin. This precludes the use of mechanical locks between metal can and mortar such as metal pins, which could extend from the metal can into the mortar layer. A system using mechanical interlocking means would require a relatively thick mortar layer. This would only aggravate shrinkage and mortar distribution problems.

Still another disadvantage of the prior art method of assembling the refractory in the metal can is the result of using prefired refractory plates. These plates are relatively difficult to manufacture and their manufacture entails a considerable cost in energy resources and manpower. Refractory shapes which are off-size, warped, chipped, or cracked must be scrapped, which significantly adds to the cost of the finished product. The finished refractory plates are themselves brittle and easily damaged during shipping, handling and the assembly operation. Damage to the correctly manufactured refractory plates adds still more to their final cost.

Yet another disadvantage of the prior art products is the expense of the manufacturing method. The prefired refractory plates that are bonded to the metal cans are made of refractory mixes which are pressed, low fired and then high fired. These prefired refractory plates are then pressed into the metal can with refractory mortar and then refired at low temperature, usually about 600° F. The elimination of the second pressing operation and the associated low firing step, as well as the elimination of the high firing step, would considerably reduce the consumption of energy and the ultimate cost of the product.

The present invention is more economical to manufacture but produces a better product. It also results in safer operation of the vessels dispensing molten metal with slide gate valves.

Additional advantages will be set forth in part in the description which follows, and in part will be obvious from the description, or may be learned by practice of the invention. The advantages of the invention may be realized and attained by means of the combinations particularly pointed out in the appended claims.

SUMMARY OF THE INVENTION

In accordance with the purposes of the invention, as embodied and broadly described herein, the present invention comprises a portion of a slide gate valve for controlling the flow of molten material, such as metal. The slide gate portion of the valve is comprised of a metal container, having an unfired coherent refractory directly affixed within it. The refractory is formed in the container from a particulate ceramic mixture that includes a binder.

Preferably, the binder bonds the particulate ceramic mixture into a coherent refractory by forming a chemical ond at a temperature below that of conventional firing temperatures, as for example, at a temperature less than 700° F. A particularly preferred binder for the present invention comprises a source of phosphorus pentoxide. It is also preferred that the source of phosphorus pentoxide forming the binder comprise phosphoric acid.

It is further preferred that the refractory be comprised of alumina or magnesia. The slide gate portion of the valve may also include means for fixing the refractory to its inner surface, such as projections from the inner surface of the container.

The preferred method of forming a slide gate portion of the valve includes providing a container for containing the refractory and then placing a particulate mixture of ceramic material and a binder into the container. The mixture is then shaped within the container by applying pressure. The mixture is then heated within the container to form a chemical bond between the ceramic particles, forming a coherent refractory and also fixing the refractory to the container.

It is preferred that where the mixture contains a source of phosphorus pentoxide to form the chemical bond, that the heating step subject the mixture to a temperature in the range of from 400° to 600° F.

BRIEF DESCRIPTION OF THE DRAWINGS

The accompanying drawings, which are incorporated in and constitute a part of this specification, illustrate one embodiment of the invention and, together with the description, serve to explain the principles of the invention.

Of the Drawings.

DESCRIPTION OF THE PREFERRED EMBODIMENTS

In order to effectively disclose the preferred embodiments of the present invention, the means of forming prior art structures is discussed.

Both the prior art and the present invention are directed to the production of a refractory slide gate component having the following general specifications:

TABLE I

| Apparent Porosity | Bulk Density | Cold MOR (Modulus of Rupture) | Hot (2700° F.) MOR |
|---|---|---|---|
| 14–18% | 2.89–3.05 gms/cc | 2000 + psi | 500 psi |

Prefired refractory plates for use in sliding gate systems of the prior art are generally manufactured of three general ceramic oxide clases: 85% $Al_2O_3$, 90% $Al_2O_3$ and 96% MgO. Within each class, blends of particulate ceramic materials are mixed with suitable binders and pressing agents. These particulate mixtures are fed to hydraulic, mechanical or impact presses for forming into suitable shapes. The pressed shapes are then dried at elevated temperatures, usually between 250° and 400° F. The dried shapes are then fired at high temperatures to effect a ceramic bond between the particles. The temperature of the firing depends on the composition of the ceramic. Normal firing temperatures are, however, usually in the range of from 2200° F. to 3200° F. It should be evident that the elimination of such a firing step has a very significant effect on the economics of manufacturing such products due to the high energy cost associated with heating materials to such temperatures.

Table II illustrates the properties typically associated with prefired refractory plates of various compositions used in conventional slide gate systems.

TABLE II

| Ceramic Class | Apparent Porosity | Bulk Density | Cold MOR | Hot (2700° F.) MOR |
|---|---|---|---|---|
| 85% Alumina | 17% | 2.82 gms/cc | 3000 psi | 1000 psi |
| 90% Alumina | 15% | 2.90 gms/cc | 2000 psi | 2100 psi |
| 96% MgO | 16% | 2.87 gms/cc | 2300 psi | 1900 psi |

The prefired plates that are within specification and have survived the various handling processes associated with their manufacture conventionally are then pressed into the supporting metal container using refractory mortar to bond the refractory plate to the metal container. The surface of the refractory plate may be ground to the appropriate finish and shaped prior to, or after, assembly into the metal container.

This method of manufacture has numerous shortcomings that have been set out above. In order to eliminate such shortcomings, the present invention was developed.

The present invention comprises a slide gate portion of a valve for controlling the flow of molten metal and a method for its manufacture.

In accordance with the invention, the slide gate portion of the valve includes a metal container. As herein embodied and most clearly illustrated in FIG. 1, the slide gate portion 10 has a shaped metal container 12 surrounding the refractory 14. The metal container has several functions.

Figure 1:
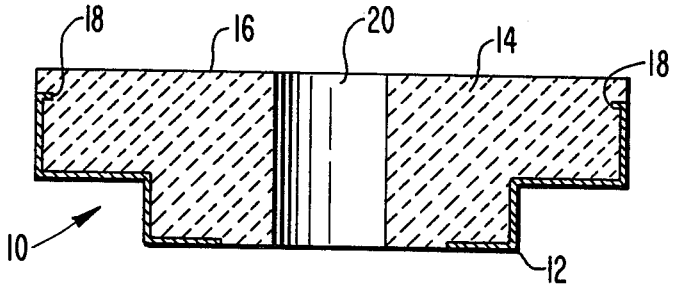
FIG. 1 is a cross-sectional view of a portion of a slide valve for a tundish.

In the present invention, as opposed to prior art devices, the container forms a portion of the mold that shapes the particulate ceramic formed into the refractory 14. The fact the container shapes the ceramic formed into the refractory and is in direct contact therewith, is a significant departure from previously disclosed prior art devices. The shape of the container is dependent upon the mechanism used to actuate the slide gate portion of the valve. The shape of the container depicted in FIG. 1 is merely illustrative of one used typically in a slide valve for a tundish. With the exception of one specific feature, to be hereinafter disclosed, the shape of the container 12 is conventional.

The refractory 14 of the device of the present invention is not bonded to the container 12 with a refractory mortar. The refractoy 14 abutts and bonds directly to the container 12. The direct bonding of the refractory to the container through the use of low fired refractories is another significant departure from the conventional devices of the prior art. The direct contact of the refractory to the container allows the present invention to include mechanical means for affixing the refractory 14 to the inner surface of the metal container.

Figure 2:
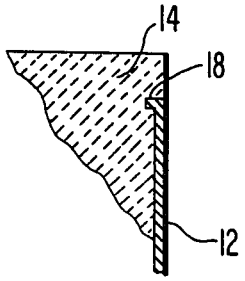
FIG. 2 is a detailed view of a portion of the embodiment of FIG. 1.

As herein embodied and depicted in detail in FIG. 2, the container 12 of the present invention may include projections on the inner surface of the container 12. The projection 18, shown in FIG. 2, is the edge of the container 12 that is bent or formed in a manner to project inwardly. This embodiment is merely illustrative of a projection or projections that could be used to accomplish the same function. The function of the projection(s) is to interlock with the refractory within the container to enhance and strengthen the attachement of the refractory to the container. Separation of the refractory from the container can cause catastrophic release of the molten metal being controlled by the valve. Such an occurrence is a very severe hazard to those using the equipment in addition to being wasteful and destructive of the equipment itself.

In accordance with the invention, the slide gate portion of the valve includes an unfired coherent refractory within the container. As herein embodied and depicted in FIG. 1, the slide gate portion 10 includes the coherent refractoy 14. The refractoy 14 is formed from particulate ceramic materials that can be rendered coherent by pressing followed by heating to a temperature below conventional firing temperatures. The refractory should also remain dimensionally stable when subjected to the temperatures of operation of the slide gate valve.

The refractory used in the present invention will depend on the type of molten materials being controlled with the slide gate valve. Basic refractories such as deadburned magnesite or synthetic periclase may be used. The refractory can be modified by the addition of such materials as refractory grade chrome ore. Acid or neutral refractories such as alumina, aluminum silicate, mullite, zirconium oxide or zirconium silicate may be used where the situation dictates.

The selection of the characteristics of the ceramic component of the refractory is within the skill of those in this technology and no exhaustive disclosure of operable refractories or their ceramic components is necessary The criteria determining whether a ceramic material will be operable with the present invention are its ability to form an unfired coherent refractory with a low temperature bond and to remain dimensionally stable when exposed to the temperature of operation of the slide gate valve.

The chemical bonding of the ceramic materials can be effected by the addition of a binder known to bond the ceramic materials and to render them coherent at relatively low temperatures. Typically, the following inorganic materials are known to form chemical bonds with ceramic materials: silicates, sulphates, nitrates, chlorides and phosphates.

Particular success has been experienced with the use of phosphate bonding for the practice of the present invention. Additions of phosphorus pentoxide ($P_2O_5$) to certain refractory compositions have been known to provide excellent low temperature chemical bonds that form the particulate ceramic to a coherent refractory. These bonds are well developed at temperatures in the 400°-600° F. range, which is compatible with the temperatures necessary to prevent the warpage or melting of the metal container surrounding the refractory. The strength of the refractory mixture formed by the development of phosphate bonds, as measured by the modulus of rupture, is adequate to allow handling of the bonded structure as well as the grinding operation forming the sealing face 16 of the slide valve portion. Exposure of the device to higher temperatures in operation does not normally alter the dimensions of the preformed refractory and the additional heating further strengthens the bonding between the particulate ceramic materials forming the refractory. The bonding of the ceramic particles to form the coherent refractory also results in the ceramic material being bonded directly to the container, thus eliminating the need for other materials, such as refractory cements or mortar, being introduced to bond the refractory to the container.

In addition to the inorganic binders disclosed, the invention may also utilize organic binder systems such as lignosulfate or pitch-bonded refractories.

In any case, the binder should form the particulate ceramic into a coherent refractory by chemically bonding the component particles at temperatures below conventional firing temperatures. Preferably, the binder will render the paticulate ceramic coherent at a temperature less than about 700° F.

One embodiment of the invention is disclosed in the following example:

A refractory mix of approximately 85% alumina was prepared in a standard dry pan mixer using phosphoric acid as a source of phosphorus pentoxide. The composition of the mix was as follows:

| Material | Weight Percent |
|---|---|
| −14 mesh Calcined Bauxite | 35 |

-continued

| Material | Weight Percent |
|---|---|
| −150 mesh Calcined Bauxite | 55 |
| −325 mesh Calcined Alumina | 5 |
| Plastic Kaolin | 5 |

To that mixture, approximately 5% by weight of 75% concentrated phosphoric acid was added and the moisture content adjusted to approximately 5 to 7 weight percent. The composition of the mixture and particle size of the components were intended to achieve a pressed product having a press density of 2.99 gms/cc.

Figure 3:
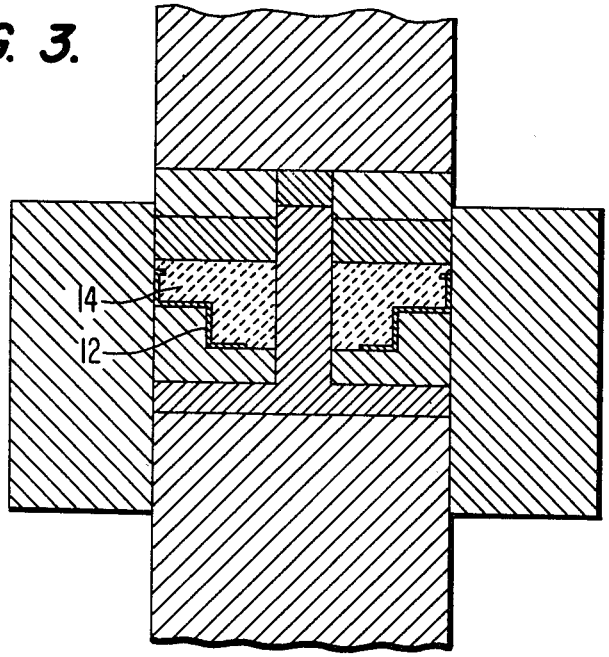
FIG. 3 is a cross-sectional view of a mold assembly for forming the embodiment depicted according to the method of the present invention.

Tooling for a hydraulic impact press, normally used to produce prefired refractory slide gate plates, was modified to accept the larger metal-supporting can as generally depicted in FIG. 3. The metal-supporting can was inserted into the press which included tooling contoured to provide full support for the metal-supporting can. A pre-weighed portion of the above described refractory mix was then charged into the metal-supporting can. The mix charged into the metal-supporting can was preweighed in order to achieve size and density control, but volume charging of the mix would also be possible.

The ceramix mix and metal support were then compressed according to standard operating procedures for this type of press. The action of the present hydraulic impact press allows maximum density to be attained at moderate pressing pressures. However, the use of screw impact, hydraulic or mechanical presses would also achieve satisfactory refractory shape and density. After pressing, the ceramic/metal assembly was removed from the press and the surrounding tooling as an integral metal can/refractory plate assembly.

Inspection and testing of the as-pressed metal can/refractory plate assembly indicated that the presence of the metal-supporting can did not interfere with the achievement of the desired press density which was measured at 2.98 gms/cc. Visual inspection of the assembly revealed clean, sharp edges, especially around the bore area. The refractory mix was pressed solidly within the metal can. Contact between the metal can and the ceranic was intimate and the assembly could be easily handled without damage to the assembly or the refractory separating and falling from the metal can.

The assembly was then placed directly into an index drier where the assembly was exposed to a temperature from 180° F. to 500° F. over a twelve hour cycle. The low fired assembly was again inspected and tested. Visual inspection revealed a hard, sharply defined refractory shape in intimate contact with the metal supporting can. The low fired refracto did not shrink away from the supporting metal can nor did the drying temperature cause excessive expansion of the metal can that could cause rupture of the bond between the refractory and the metal can.

The results of testing the low fired assembly (as set out in Table III below) indicate the assembly meets the desired properties for such assemblies as set out previously in Table I.

TABLE III

| Refractory Component | Apparent Porosity | Bulk Density | Cold MOR | Hot (2700° F.) MOR |
|---|---|---|---|---|
| 85% Alumina Class | 17% | 2.84 gms/cc | 2400 psi | 1000 psi |

As the above example illustrates, the present invention is capable of providing a component of a slide gate valve having the necessary properties for such components with significat advantages while being produced at significant savings.

The present invention in both its article and method embodiments is disclosed herein both generally and by example. It will be apparent to those skilled in the art that modifications and variations of the disclosed invention can be made. Such modifications and variations of the disclosed invention are intended to be within the scope of the invention as defined by the appended claims.

What is claimed is:

1. A method of forming a slide gate portion of a valve for controlling the flow of molten material, said method comprising the steps of:

(a) providing a metal container disposed to form the metal portion of a slide gate valve, said container including an open portion for containing a refractory therein;

(b) placing a particulate mixture of ceramic material and a binder into said open portion of said refractory containing portion of said container;

(c) shaping said mixture in said container by applying pressure thereto while fully supporting said container; and (d) heating said mixture in said container to form a chemical bond between the ceramic particles and to form a coherent unfired refractory and also to affix said refractory directly to said container.

2. The method of claim 1 wherein said mixture contains a source of phosphorus pentoxide to form said chemical bond and said heating step includes subjecting said mixture to a temperature in the range of 400° to 600° F.

3. A method of forming a slide gate portion of a valve for controlling the flow of molten material, said method comprising the steps of:

(a) providing a metal container disposed to both shape and contain a particulate mixture of ceramic material and a binder therein;

(b) placing said mixture within said metal container;

(c) applying pressure to said mixture and said container to: shape said mixture within said container, densify said mixture, and provide intimate contact between said mixture and said container thereby forming an integral assembly consisting of said mixture and said container; and (d) heating said integral assembly below the firing temperature of said ceramic material to form a chemical bond between the ceramic particles in said mixture, thereby forming a coherent unfired refractory, said heating also affixing said refractoy directly to said container, thereby forming said slide gate portion consisting of a coherent unfired refractory directly affixed to said metal container.

4. The method of claim 3 wherein said refractory has an apparent porosity in the range of 14 to 18%.

5. The method of claim 3 wherein said binder comprises an inorganic material.

6. The method of claim 3 wherein said binder comprises phosphorous pentoxide or a source of phosphorous pentoxide.

7. The method of claim 3 wherein said binder is selected from the group consisting of: silicates, sulphates, nitrates and chlorides.

8. The method of claim 3 wherein said binder comprises an organic material.

9. The method of claim 3 wherein said binder comprises a lignosulfate.

10. The method of claim 3 wherein said refractory is a pitch-bonded refractory.

11. The method of claim 3 wherein said integral assembly is heated to below about 700° F.

* * * * *